US006629890B2

(12) United States Patent
Johnson

(10) Patent No.: US 6,629,890 B2
(45) Date of Patent: Oct. 7, 2003

(54) SAFE GAMING SYSTEM

(76) Inventor: Richard A. Johnson, 1096 Lehigh Valley Cir., Danville, CA (US) 94526

( * ) Notice: Subject to any disclaimer, the term of this patent is extended or adjusted under 35 U.S.C. 154(b) by 101 days.

(21) Appl. No.: 09/759,440

(22) Filed: Jan. 16, 2001

(65) Prior Publication Data

US 2001/0031663 A1 Oct. 18, 2001

Related U.S. Application Data

(60) Provisional application No. 60/177,182, filed on Jan. 20, 2000.

(51) Int. Cl.[7] ..... A63F 9/24

(52) U.S. Cl. ..... 463/25; 463/24; 463/40; 463/41; 463/42

(58) Field of Search ..... 463/40–42, 16–22, 463/24–25

(56) References Cited

U.S. PATENT DOCUMENTS 5,910,048 A * 6/1999 Feinberg ..... 463/25
6,244,957 B1 * 6/2001 Walker et al. ..... 463/20
6,280,328 B1 * 8/2001 Holch et al. ..... 463/42
6,302,793 B1 * 10/2001 Fertitta, III et al. ..... 463/25
6,364,765 B1 * 4/2002 Walker et al. ..... 463/16

* cited by examiner

*Primary Examiner*—S. Thomas Hughes
*Assistant Examiner*—Carmen D. White
(74) *Attorney, Agent, or Firm*—Tipton L. Randall

(57) ABSTRACT

A gaming control system applicable to all forms of gambling, electronic or otherwise, is disclosed. The system includes an Internet Web site, with associated control software, which is a portal that serves as a "safe gaming" interface between online gambling individuals and Internet-based gambling sites. The system also allows players at physical gaming locations to register with the system or "safe gaming" at video terminals or at gaming tables. The portal software and distributed components of the system, track an individual's gaming transactions and provide alerts to the individual of reaching or exceeding loss limits, time limits, changes in gambling behavior, and other related services.

22 Claims, 1 Drawing Sheet

SAFE GAMING SYSTEM

CROSS-REFERENCE TO RELATED APPLICATIONS, IF ANY

This application claims the benefit under 35 U.S.C. §119 (e) of co-pending provisional application Ser. No. 60/177,182, filed Jan. 20, 2000. Application Ser. No. 60/177,182 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a control system for gaming, and more particularly, to a control system for individuals who require or desire to limit gaming expenditures, time spent gambling and other, related parameters and factors.

2. Background Information

Gaming or gambling has been a part of human history since antiquity. Participants traditionally have engaged in gaming or gambling activities in a face-to-face relationship. Commercial establishments, termed casinos, for gaming or gambling are recent developments, but participants still carried out gaming or gambling activities in a face-to-face relationship.

More recently, electronic gaming or gambling machines have become important means of participating in gambling. Examples of electronic gaming or gambling machines include slot machines, video poker machines, and similar electronic games. Until recently, in order to participate in gambling or gaming activities, individuals still were required to travel to an establishment where these electronic machines are housed.

An even more recent development is gaming or gambling over the Internet or World Wide Web (on line), which is generally defined as a global data telecommunications network. The individual merely has to connect to the Internet through a computer having a phone line modem, or another means of access to the Internet, log on to a gaming Web site, and participate in a wide variety of gaming or gambling activities that are offered online. The participating individuals employ credit card or similar credit accounts as a source of funds for these gaming activities.

Many individuals have either become addicted to gaming or gambling activities, or have developed gambling-related problems due to an inability to properly control their impulses to gamble. In many cases, such gambling problems have resulted in financial ruin due to gambling losses, as well as psychological and/or physiological problems and severe family problems. Other individuals, though not addicted, nor currently having a serious problem with gamboling, desire to limit the amount of funds and time spent on gambling activities to avoid the development of problems. Thus, there is an unmet need for a gaming control system that monitors gaming activities and thereby can be programmed to help both problem gamblers and those who wish to avoid developing a problem, by limiting the amount of funds spent by an individual on gaming activities, and/or time spent gambling. In addition, the system can observe behavioral changes related to gambling that may indicate developing "problem gambling" issues. Applicant has devised such a gaming control system that is applicable to all forms of gaming or gambling, including electronic means.

SUMMARY OF THE INVENTION

The invention is a gaming control system applicable to all forms of gambling, electronic or otherwise. The system includes an Internet Web site, and associated control software, which constitutes a portal that serves as a "safe gaming" interface between individuals who gamble online and Internet-based gambling sites. The system also allows players at physical gaming locations to register with the system in order to participate in "safe gaming" at video terminals or at gaming tables. The control software tracks each registered individual's gaming transactions and interjects alerts to the individual when reaching loss limits, time limits, or when changes in gambling behavior signal an issue, and other related services. There is an "expert system" component to the software, in that knowledge of the individual user, the gambling games, and gambling behavior are programmed into the applications. Using this "knowledge base", the software can then reveal variances from the norm or established parameters, and recognize problems based upon comparison of monitored behavior with the knowledge base.

DESCRIPTION OF THE PREFERRED EMBODIMENTS

Figure 1:
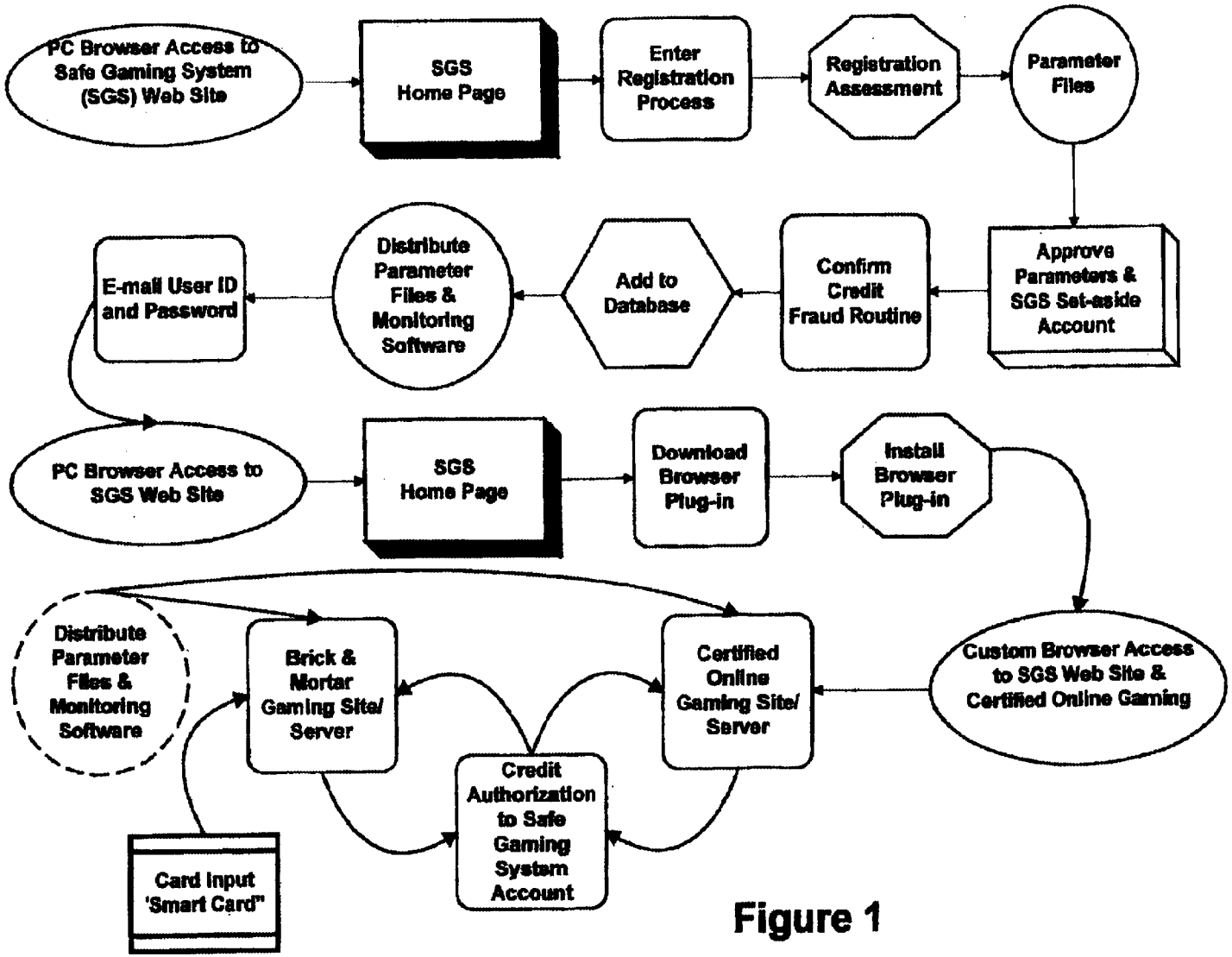
FIG. 1 is a schematic flow chart of the method of the present invention.

The system of the present invention is suitable for individuals who have a compulsive gambling addiction or gambling-related problems, as well as individuals who desire to set a specified limit to their gambling losses for a particular time period, and/or monitor their own gambling behavior to avoid or help resolve problems. The service provides a portal that serves as a "safe gaming" interface between online gamblers and Internet-based gambling sites and other gaming sites, whether the gambling site is electronic or physical. The system also allows those who play at traditional casinos, that is, "brick and mortar" gaming locations, to register for safe gaming at video terminals and gaming tables by use of a "pass card" or "smart card" device that can be used in the same slot as, or is integrated with a "reward card" issued by gaming establishments. The system tracks a player's gaming time, expenditures, and other behavior such as speed of play and quality of gaming decisions. The system is capable of imposing financial and/or time limitations on gambling that the player has agreed to set for him/herself through the safe gaming system registration process, or similar limits that may be legislated or imposed by the jurisdiction. The system also provides real time alerts when a player approaches thresholds or limits of the parameters set for him/her while gambling, or when the player exhibits significant changes in individual gambling behavior. Other functions of the system are to gather statistics on individual users and report the registered gambler's behavior. The use of the Safe Gaming System by an individual, hereinafter also referred to as the "user", the "client" and/or the "player", is as follows.

Registration

As the preferred method, the user can personally register for the service by logging on to the Safe Gaming System Internet Web site. Alternately, another entity, for example a governmental agency, a gaming company, an online gaming site, or a credit card company may be permitted to perform the service of assisting in registering the user. In addition, a telephone service for those users who wish to register by telephone can be provided. To register personally on the Internet, the user points his/her Web browser software to connect with the Safe Gaming System Web site. Here, the prospective client can read about the services provided, and sign up, online, to use the service. When the client (user) clicks on "Sign Me Up" or "Register Now", as provided on the Web site, the first screen details the steps to establish an account.

First, the user is presented a series of questions and information to fill out on line. This information exchange from the user to the system's database allows an "assessment" of the user's personal financial, social, and psychological factors that help to determine the gaming control parameters that should be implemented once the registration process is complete. These gaming control parameters are used in the monitoring software that tracks gambling activity and intervenes when appropriate.

At the end of the assessment, the user is presented with the "expert system's" suggested parameters, based upon the responses he/she provided, including any legislated or jurisdictional parameters, and the guidelines and norms maintained within the system. Among other things, monetary amounts to limit losses over a period of time, and a time budget for gambling are suggested. The user's current susceptibility to developing problems with gambling is determined by the system in real time and presented, along with appropriate suggested action. The user then validates the system's suggested parameters or enters a process wherein the user chooses and specifies all the relevant parameters that are necessary for monitoring and reporting of gambling activity by the Safe Gaming System. Then, a final review of the parameters is presented to the user for approval, along with the standard agreement for authorizing use of the information and for establishing a "controlled account" with the system. Once the user "accepts" the data, it is stored in the system's secure database and is made ready for use within a short confirmation period, usually within 24 hours. A temporary confirmation can be provided in a matter of few minutes, if/as commercially required. As part of the confirmation process, an account number and password are assigned to the user and an e-mail is sent to the user's specified address, transmitting the account number and password assigned to the account. If desired, the user may change the password later. In cases where a temporary password is needed, for security purposes, a replacing password will be contained in the follow-on e-mail message to the user. In addition to confirmation by e-mail, the user may make a printed record of the account number and password and in some cases, the registration will be coupled with the issuance of a "smart card" with the encoded Safe Gaming System account number and other related information "encoded" on the card.

During the period immediately following initial registration by the user, credit checks and other security verifications are performed as a part of the Safe Gaming System process, to minimize the possibility of fraud or misrepresentation. A unique, permanent account (identification) number is assigned to the new user (client), which associates the monitoring parameters established and information required for personal identification. Key fields of this account information are periodically transmitted in encrypted format to the "back end" systems of all certified gaming operators for use to identify Safe Gaming System clients on their internal networks and servers. In some cases, additional software modules will be transmitted and/or updated that enables each certified gaming operator's servers to recognize, acknowledge and implement the safe gaming parameters established for each Safe Gaming System user that plays their games.

As a part of the registration authorization, a separate, special monetary set-aside for gaming purposes within the user's Safe Gaming System account number is strongly recommended. The set-aside amount will be governed by the system parameters and is to be established and administered through a secure server within the Safe Gaming System. If the user agrees to establish this set-aside, this then serves as the exclusive account to be used for debit and credit transactions initiated from gaming sites and locations, in lieu of any other "unprotected" account the client may have. Each transaction to and from this special account is reported to and controlled by the Safe Gaming System. In addition, agreements are established between certified gaming operators, credit card companies, financial institutions, and the Safe Gaming System that all gaming transactions will be controlled by and limited to the Safe Gaming System account. For example, if a user's loss limits have been reached for a specific period, further transfers of money into the Safe Gaming System account will be denied for that period and no certified gaming operator will accept other forms of payment for gambling activities.

Start Up

Once the client receives an account number and password, instructions are presented to log on to the Safe Gaming System to download the necessary software to begin use of the system for on line gaming. The client is prompted for the authorized user account identification and password and, upon successful entry, a download of the Safe Gaming System browser "plug-in" software occurs. Once the user installs the browser plug-in, he/she is ready to use the service, as applied for Internet gaming. Instructions on proper use are contained within the browser's help files and within a separate text file provided. Once the user installs the browser plug-in, the Safe Gaming System is immediately useable for online gaming. All certified gaming operators must make an online, real-time request for the parameters needed from the Safe Gaming System to allow a new user to play on line. The Safe Gaming System provides the key parameters and then gaming can begin. For using the system at "brick and mortar" casinos, the issuance of a "smart card" is required by either the Safe Gaming System or the casino operator.

Using the System

In all cases when using the system, the user's account number must be provided; either by the browser software, the "smart card" or by manual input, and the password must be correctly input by the user. The user logs on to the Safe Gaming System through the custom browser and may view a list of certified online gaming sites and/or other certified gaming sites. The user can connect to the certified online site of his/her choice for gaming from the Safe Gaming System Web site or directly, as desired. As gaming proceeds, all transactions are processed only through the user's special account, if the user elected to establish the account. The browser software and/or the software placed on the certified gaming operator's servers, will not allow any other accounts to be used, if the user elected to establish the special 'gaming account'. The limits imposed on this account comply strictly with the parameters established for each user. For example, if the client has agreed to a loss limitation of $100 per week only that amount is available for authorized transactions from all gaming sites, collectively. Therefore, all participating certified "brick and mortar" and online sites would operate under and impose these common limitations just by the fact that they agree only to debit and credit gaming transactions through the user's Safe Gaming System account (set-aside). If the user does not elect to establish the special gaming account, the system accumulates charges to cash, 'unprotected' credit card accounts or debits to checking accounts as authorized by the user. The system still produces control messages, and has the capability to stop gaming activities when limits are reached. However, the system may not have direct control over allowing further charges in those cases where the user elects not to establish a Safe Gaming System set-aside account. The net effect of this is that the system still works but is not as effective in those cases where the special account is not present.

The limitations are strongly enforced when the "brick and mortar" sites and online sites are only authorized to interface with the user's Safe Gaming System account. For "brick and mortar" sites, this is controlled through the Safe Gaming System's special, coded "smart card" or the modified player's "reward card" that is issued by the casino. The "smart card" is directly inserted into the card slot at gaming video terminal devices. It may also be "swiped" into a terminal by the dealer or operator for gaming activities at any table game. The process of inserting the card identifies the client and begins the process of monitoring and control.

A special module of the Safe Gaming System's monitoring software is resident on each certified casino's system as a compliant part of the standard certification agreement. The local system also has a connection to the Safe Gaming System Web site. The system software is activated by the player's card input that identifies the user as a Safe Gaming System customer. The "brick and mortar" application software executes essentially the same tracking and monitoring process as is performed via the custom browser when participating in online gaming. The browser software, online server software and/or the "brick and mortar" server software modules all monitor the user's gaming activities. Warning messages, instructional interludes, and other appropriate alerts and services are available through single clicks on the browser menu or through the "brick and mortar" system. All of the systems are connect to the Safe Gaming System site, where the data is aggregated in real time and overall, central control functions are performed. The Safe Gaming System Web site and associated software applications are functional around the clock, so that gaming activities can be monitored and controlled at any time and continuously.

Players can register online to gamble through the "safety net" provided by the Safe Gaming System. The player is assessed, through an online "test" questionnaire during the initial registration process and periodically thereafter as initiated by either the player's request or by the system. The system will initiate re-assessment of parameters on a set schedule or on occasions when gambling behavior patterns are observed to be changing. A valid, current assessment is needed to determine the user's up-to-date social and economic status, and his/her changing susceptibility to developing problem gambling issues. Limits on monetary losses and time devoted to playing are set during the assessment process, and these limits are subsequently used in monitoring. Parameters are established, and thereafter modified only as needed, to serve as guides in monitoring the player's gambling activity in real time. Interactive alert messages are introduced to the player as his/her activity warrants. For example, a message may state: "You will reach your time limit for gambling activities this week in 15 minutes." All monetary transactions between the player and the gaming site are screened and approved through the Safe Gaming System in real time. That is, all transactions must be within established parameters to be approved and processed. The Safe Gaming System software is also capable of directly terminating or signaling for a casino to terminate an individual's gaming activities when the individual reaches the predetermined loss limit, time limit or other limiting parameters that are pre-agreed. Reports of actual gambling activity are offered periodically to players to provide statistics, indicate trends, point out issues, and make recommendations regarding gambling behavior. Associated services are offered that provide training, awareness, referrals to needed professional help, guidelines for safe gaming, and other features.

A schematic flow diagram of the overall process of the present invention is shown in FIG. 1. The Safe Gaming System Website is designated as the "Safe Gaming System" or "SGS" in the flow diagram of FIG. 1.

Gaming Sites

Only certified gambling sites such as casinos, lotteries, online gaming sites, video lottery terminals (VLTs) and other gambling facilities that can communicate electronically with the Safe Gaming System are listed on and/or accessible through the Safe Gaming System Web site. Certification of gambling sites includes both technical compliance testing by Safe Gaming System personnel and review and approval of the practices of the gaming operators as related to their treatment of customers. All transactions between the player and the gaming site are screened and approved through the Safe Gaming System in real time. That is, all expenditures must be within established parameters to be approved and processed.

While the invention has been particularly shown and described with reference to preferred embodiments thereof, it will be understood by those skilled in the art that various changes in form and details may be made therein without departing from the spirit and scope of the invention.

I claim:

1. A method for automatically monitoring, regulating and terminating the gaming activities of an individual, via a global telecommunications network, the method comprising the steps:

(a) accepting selected profile attributes agreed to by the individual, the attributes including personal financial, social and psychological factors, gambling behavior including speed of play and quality of decisions, and specific gaming control parameters, into a first data base;

(b) accepting selected gaming sites into a second data base;

(c) establishing a unique account for the individual in the first data base;

(d) providing to each selected gaming site in the second data base, access to said first data base plus operating software for monitoring and terminating the gaming activities of an individual;

(e) providing unique mean for an individual to identify the individual's profile attributes and unique account in the first data base;

(f) supplying the identifying means by an individual to a selected gaming site to commence gaming activities;

(g) monitoring by the operating software the gaming activities between an individual with profile attributes and unique account in said first data base and a gaming site in said second data base; and (h) providing expert regulation of the gaming activities of an individual, expert regulation including monitoring changes in gambling behavior, changes in speed of play, changes in quality of decisions, monetary end point and total time end point, expert regulation including terminating by the operating software the gaming activities of an individual upon the individual deviating from at least one of said selected profile attributes of the individual in said first data base.

2. The method for automatically monitoring, regulating and terminating the gaming activities of an individual according to claim 1, wherein said specific gaming control parameters include a specific monetary loss limit for a specific time period.

3. The method for automatically monitoring, regulating and terminating the gaming activities of an individual according to claim 1, wherein accepting selected profile attributes entered by the individual into a first data base and accepting selected gaming sites into a second data base is via a global communications network.

4. The method for automatically monitoring, regulating and terminating the gaming activities of an individual according to claim 1, wherein establishing a unique account for the individual in the first data base includes only accumulating a record of gaming transactions with uncontrolled monetary sources for the individual.

5. The method for automatically monitoring, regulating and terminating the gaming activities of an individual according to claim 1, wherein establishing a unique account for the individual in the first data base includes providing a gaming account of specified monetary value for a selected time period for gaming transactions for an individual, and accumulating a record of gaming transactions for the individual.

6. The method for automatically monitoring, regulating and terminating the gaming activities of an individual according to claim 1, wherein providing access to said first data base plus operating software to each selected gaming site in the second data base includes copying the first data base plus operating software for monitoring and terminating the gaming activities of individuals to a server of the selected gaming site.

7. The method for automatically monitoring, regulating and terminating the gaming activities of an individual according to claim 1, wherein the unique identifying means for an individual includes an electronically readable card device.

8. The method for automatically monitoring, regulating and terminating the gaming activities of an individual according to claim 1, wherein the unique identifying means for an individual includes an identification name and password assigned to the individual's unique account.

9. The method for automatically monitoring, regulating and terminating the gaming activities of an individual according to claim 1, further including periodically notifying the individual of current monetary amounts expended and current gaming time expended by the individual.

10. The method for automatically monitoring, regulating and terminating the gaming activities of an individual according to claim 1, further including providing a warning message to the individual upon the individual's gaming activities approaching a limit of at least one of said selected profile attributes of the individual.

11. The method for automatically monitoring, regulating and terminating the gaming activities of an individual according to claim 1, further including providing a summary report to an individual on the individual's gaming activities.

12. The method for automatically monitoring, regulating and terminating the gaming activities of an individual according to claim 1, wherein the selected profile attributes agreed to by the individual in step (a) include gaming control parameters determined by legislation and jurisdiction.

13. A method for automatically monitoring, regulating and terminating the gaming activities of an individual, via a global telecommunications network, the method comprising the steps:

(a) accepting selected profile attributes agreed to by the individual, the attributes including personal financial, social and psychological factors, gambling behavior including speed of play and quality of decisions, and specific gaming control parameters, via the global telecommunications network into a first data base;

(b) accepting selected gaming sites via the global telecommunications network into a second data base;

(c) establishing a unique account for the individual in the first data base;

(d) providing unique means for an individual to identify the individual's profile attributes and unique account in the first data base;

(e) providing a system portal on the global telecommunications network, said system portal containing said first and second data bases plus operating software for monitoring and terminating the gaming activities of an individual;

(f) providing a unique browser-integrated, software program to the individual for accessing said system portal on the global telecommunications network, and for activating monitoring upon connection to a selected online gaming site in said second data base;

(g) selecting a gaming site in said second data base with said unique browser-integrated, software program by an individual with profile attributes and unique account in said first data base via the global telecommunications network;

(h) sending gaming activities via the global telecommunications network between an individual with profile attributes and unique account in said first data base and a gaming site in said second data base;

(i) monitoring by said system portal software of the gaming activities via the global telecommunications network between an individual with profile attributes and unique account in said first data base and a gaining site said second data base; and (j) providing expert regulation of the gaming activities of an individual, expert regulation including monitoring changes in gambling behavior, changes in speed of play, changes in quality of decisions, monetary end point and total time end point, expert regulation including terminating by said system portal software the gaming activities of an individual upon the individual deviating from at least one of said selected profile attributes of the individual in said first data base.

14. The method for automatically monitoring, regulating and terminating the gaming activities of an individual according to claim 13, wherein said specific gaming control parameters include a specific monetary loss limit for a specific time period.

15. The method for automatically monitoring, regulating and terminating the gaming activities of an individual according to claim 13, wherein establishing a unique account for the individual in the first data base includes only accumulating a record of gaming transactions with uncontrolled monetary sources for the individual.

16. The method for automatically monitoring, regulating and terminating the gaming activities of an individual according to claim 13, wherein establishing a unique account for the individual in the first data base includes providing a gaming account of specified monetary value for a selected time period for gaming transactions for the individual, and accumulating a record of gaming transactions for the individual.

17. The method for automatically monitoring, regulating and terminating the gaming activities of an individual according to claim 13, wherein the unique identifying means for an individual includes an identification name and password assigned to the individual's unique account.

18. The method for automatically monitoring, regulating and terminating the gaming activities of an individual according to claim 13, further including periodically notifying the individual of current monetary amounts expended and current gaming time expended by the individual.

19. The method for automatically monitoring, regulating and terminating the gaming activities of an individual according to claim 13, further including providing a warning message to the individual upon the individual's gaming activities approaching a limit of at least one of said selected profile attributes of the individual.

20. The method for automatically monitoring, regulating and terminating the gaming activities of an individual according to claim 13, further including providing a summary report to an individual on the individual's gaming activities.

21. The method for automatically monitoring, regulating and terminating the gaming activities of an individual according to claim 13, wherein the selected profile attributes agreed to by the individual in step (a) include gaming control parameters determined by legislation and jurisdiction.

22. A method for automatically monitoring, regulating and terminating the gaming activities of an individual, the method comprising the steps:

(a) accepting selected profile attributes agreed to by the individual, the attributes including personal financial, social and psychological factors, gambling behavior including speed of play and quality of decisions, and including a specific monetary loss limit for a specific time period, into a first data base;

(b) accepting selected gaming sites into a second data base;

(c) establishing a unique account for the individual in the first data base, said unique account including a gaming account of specified monetary value for a selected time period for all gaming transactions for the individual, and the unique account accumulating a record of gaming transactions for the individual;

(d) providing to each selected gaming site in the second data base, access to said first data base plus operating software for monitoring and terminating the gaming activities of an individual;

(e) providing unique means for an individual to identify the individual's profile attributes and unique account in the first data base;

(f) supplying the identifying means by an individual to a selected gaming site to commence gaming activities;

(g) monitoring by the operating software the gaming activities between an individual with profile attributes and unique account in said first data base and a gaming site in said second data base; and (h) providing expert regulation of the gaming activities of an individual, expert regulation including monitoring changes in gambling behavior, changes in speed of play, changes in quality of decisions, monetary end point and total time end point, expert regulation including terminating by said system portal software the gaming activities of an individual upon the individual deviating from at least one of said selected profile attributes of the individual in said first data base.

* * * * *